US005492411A

United States Patent [19]

May

[11] Patent Number: 5,492,411

[45] Date of Patent: Feb. 20, 1996

[54] TAMPER EVIDENT PEELABLE SEAL

[75] Inventor: Timothy J. May, Greenville, Wis.

[73] Assignee: Reynolds Consumer Products Inc., Appleton, Wis.

[21] Appl. No.: 374,361

[22] Filed: Jan. 18, 1995

[51] Int. Cl.[6] ..... B65D 33/16

[52] U.S. Cl. ..... 383/5; 383/61; 383/63; 383/210; 493/213; 493/214

[58] Field of Search ..... 383/5, 210, 211, 383/61, 63; 493/213, 214

[56] References Cited

U.S. PATENT DOCUMENTS

| | | | |
|---|---|---|---|
| 3,827,625 | 8/1974 | Miller | 383/211 |
| 4,097,236 | 6/1978 | Daly et al. | 23/230 L |
| 4,576,285 | 3/1986 | Goglio | 383/210 |
| 4,834,552 | 5/1989 | Makowka | 383/5 |
| 4,966,470 | 10/1990 | Thompson et al. | 383/61 |
| 5,064,664 | 11/1991 | Hustad | 426/87 |
| 5,077,001 | 12/1991 | Makowka | 383/5 |
| 5,082,702 | 1/1992 | Alband | 428/36.92 |
| 5,103,979 | 4/1992 | Hustad | 206/459 |
| 5,104,704 | 4/1992 | Labes et al. | 428/35.7 |
| 5,224,779 | 7/1993 | Thompson et al. | 383/5 |
| 5,238,306 | 8/1993 | Heintz et al. | 383/61 |
| 5,330,269 | 7/1994 | Kamada | 383/210 |

*Primary Examiner*—Stephen P. Garbe
*Attorney, Agent, or Firm*—Alan T. McDonald

[57] ABSTRACT

A closure arrangement for a polymeric bag with first and second opposing films comprises first and second opposing base strips, a first peelable strip of a first color, and a second peelable strip of a second color. An outer surface of the first base strip is attached to an inner surface of the first film. An outer surface of the second base strip is attached to an inner surface of the second film. The first peelable strip is attached to the inner surface of the first base strip, and the second peelable strip is attached to the inner surface of the second base strip. The first and second peelable strips are disposed between the first and second base strips. The second peelable strip is generally parallel to and opposes the first peelable strip. The second color of the second peelable strip is lighter than the first color of the first peelable strip. The first color of the first peelable strip is visible through the second peelable strip when the first and second peelable strips are heat sealed to each other to form a peelable seal. The second color of the second peelable strip substantially masks the first color of the first peelable strip when the peelable seal is broken. Thus, breaking the peelable seal produces an irreversible color change in the peelable seal area. Such an irreversible visual change alerts a consumer that the peelable seal has previously been broken.

22 Claims, 2 Drawing Sheets

TAMPER EVIDENT PEELABLE SEAL

FIELD OF THE INVENTION

The present invention generally relates to closure arrangements for polymeric (plastic) bags and, more particularly, relates to a closure arrangement having a peelable seal which is so constructed so as to alert a consumer when the seal is intact and when it has been broken.

BACKGROUND OF THE INVENTION

In many consumer packaging applications, it is important to prevent air or water or the like from passing out of or into a package containing certain products. This is particularly true with respect to meat packages, cheese packages, and the like, for which the contained product must be kept in a constant environment to prevent spoilage. It is also important to protect such products from tampering. In order to preserve the integrity and safety of a product contained within such a package, the periphery of the package must be hermetically sealed. Hermetic seals can be provided by both permanent seals and temporary seals known as peelable seals. Peelable seals are capable of providing a hermetic seal and, at the same time, providing a consumer with access to the contents of a package. A consumer breaks a peelable seal of a package by first grabbing onto opposing film faces to which peelable seal materials are adhered and then pulling the film faces apart. To provide a peelable seal on a package with a reclosable zipper, the package typically uses permanent seals at its side edges and bottom edge and a peelable seal above or below the reclosable zipper at the mouth end of the package. In addition, the peelable seal may be arranged on either the flange/base portions of the zipper or on the packaging film adjacent to the flange portions.

There are a couple of typical approaches for forming peelable seals on reclosable packages having a top and bottom film. One typical approach adheres a multilayered film to each of the opposing inner surfaces of the packaging film (or zipper flange portions) along the length of the mouth end of the package. This results in a first multilayered film on the inner surface of the top film and a second multilayered film on the inner surface of the bottom film. A peelable seal is formed by heat sealing the first and second multilayered films to one another. When a consumer breaks the peelable seal, one or more layers of the second multilayered film will disengage from the other layers of the second multilayered film and remain adhered to the first multilayered film. As a result, the first multilayered film will include at least one additional layer when the peelable seal is broken. The above layer disengagement upon breaking the peelable seal is accomplished by using film layers composed of different polymeric materials and by exploiting the varying bond strengths between the layers.

Another typical approach adheres a layer of film to each of the opposing inner surfaces of the packaging film (or zipper flange portions) and introduces contaminants to one or both of the film layers. When the peelable seal is formed by heat sealing the layers to one another, the bond between them is weak due to the surface contamination. Breaking the peelable seal detaches the layers from one another.

The foregoing described general constructions of polymeric bags and specifically peelable seals create hermetically sealed reclosable packages. These constructions, however, have not adequately addressed the task of alerting consumers when such a peelable seal has been broken.

Clearly, there is a need for a peelable seal design which provides tamper evidence indicative of a broken peelable seal.

SUMMARY OF THE INVENTION

In one embodiment of the present invention, a closure arrangement for a polymeric bag with first and second opposing films comprises first and second opposing base strips, a first peelable strip of a first color, and a second peelable strip of a second color. An outer surface of the first base strip is attached to an inner surface of the first film. An outer surface of the second base strip is attached to an inner surface of the second film. The first peelable strip is attached to the inner surface of the first base strip, and the second peelable strip is attached to the inner surface of the second base strip. The first and second peelable strips are disposed between the first and second base strips, and the second peelable strip is generally parallel to and opposes the first peelable strip. The second color of the second peelable strip is lighter than the first color of the first peelable strip. The first color of the first peelable strip is visible through the second peelable strip when the first and second peelable strips are heat sealed to each other to form a peelable seal. The second color of the second peelable strip substantially masks the first color of the first peelable strip when the peelable seal is broken. Thus, breaking the peelable seal produces an irreversible color change in the peelable seal area. Such an irreversible visual change alerts a consumer that the peelable seal has previously been broken.

In another embodiment of the present invention, a closure arrangement for a polymeric bag with first and second opposing films comprises a first base strip, a second base strip, and a peelable strip. The second film of the polymeric bag is of a first color, while the peelable strip is of a second color. The first color is lighter than the second color. An outer surface of the first base strip is attached to an inner surface of the first film. The second base strip is generally parallel to and opposes the first base strip, and an outer surface of the second base strip is attached to an inner surface of the second film. The peelable strip is attached to the inner surface of the first base strip and is disposed between the first base strip and the second film. The second color of the peelable strip is visible through the second film when the peelable strip and the second film are heat sealed to each other to form a peelable seal. The first color of the second film substantially masks the second color of the peelable strip when the peelable seal is broken.

BRIEF DESCRIPTION OF THE INVENTION

Other objects and advantages of the invention will become apparent upon reading the following detailed description and upon reference to the drawings in which.

Figure 3:
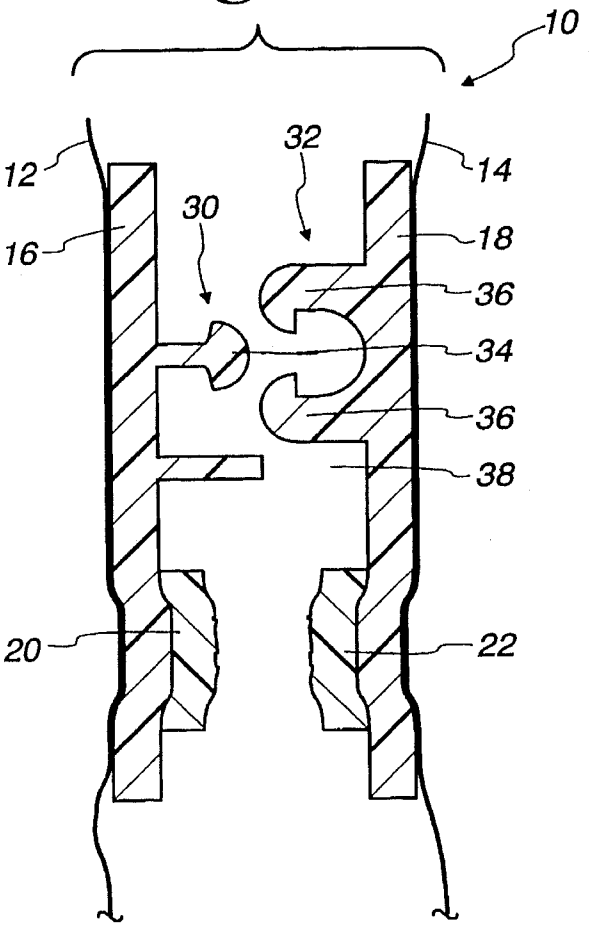
FIG. 3 is the same sectional view as in FIG. 1, after breaking the peelable seal.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
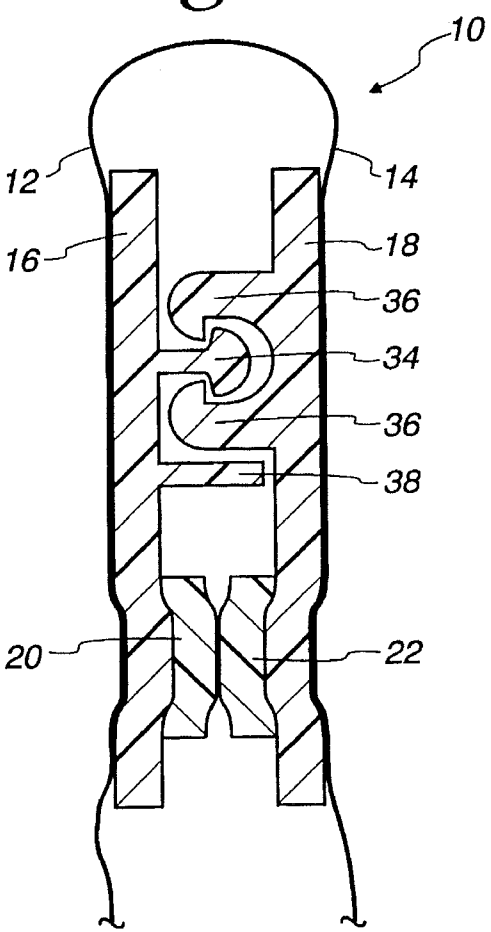
FIG. 2 is the same sectional view as in FIG. 1, after forming the peelable seal.
Figure 1:
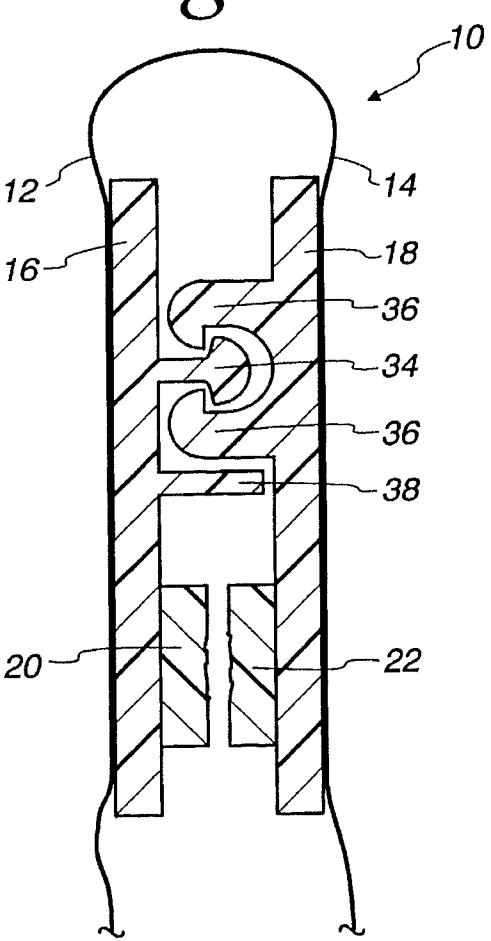
FIG. 1 is a sectional view of a closure arrangement embodying the present invention, prior to forming a peelable seal.

Turning now to the drawings, FIGS. 1–3 illustrate a sectional view of a closure arrangement 10 for a reclosable bag having a top film 12 and a bottom film 14. The closure arrangement 10 includes a pair of flat transparent base strips 16, 18 and a pair of flat peelable strips 20, 22. The base strips 16, 18 and the peelable strips 20, 22 are disposed at the mouth of the reclosable bag and extend along the length of the bag mouth. Moreover, the base strips 16, 18 and the peelable strips 20, 22 are parallel to each other along the length of the bag mouth. An outer surface of the base strip 16 is firmly attached to an inner surface of the top film 12, and an outer surface of the base strip 18 is firmly attached to an inner surface of the bottom film 14. The peelable strip 20 is attached to the inner surface of the base strip 16, and the peelable strip 22 is attached to the inner surface of the base strip 18. Thus, the peelable strips 20, 22 are situated between the base strips 16, 18.

To provide the closure arrangement 10 with a reclosable zipper, the base strips 16, 18 have integrally formed therewith respective male and female closure profiles 30, 32. The male closure profile 30 extends inwardly from the inner surface of the base strip 16 and includes a single locking member 34 with an expanded head. The female closure profile 32 extends inwardly from the upper flange portion of the base strip 18 and includes a pair of flexible locking members 36 with hooks at the ends thereof. The pair of locking members 36 are disposed opposite the single locking member 34 and are spaced by a sufficient distance that the expanded head of the single locking member 34 is releasably engageable between the pair of locking members 36. More specifically, the pair of locking members 36 interlock with the single male locking member 34 in a snapping action caused by bringing the hooks of the pair of locking members 36 passed the expanded head of the locking member 34. To facilitate alignment of the pair of locking members 36 with the locking member 34 during reclosure, the male closure profile 30 is provided with a guide post 38 for guiding one of the pair of locking members 36 between the guide post 38 and the locking member 34. If desired, the closure arrangement 10 may be designed without a reclosable zipper. In addition, the closure arrangement 10 may be designed without the base strips 16, 18 so that the peelable strips 20, 22 and the closure profiles 30, 32 are attached directly to the respective top and bottom films 12, 14 of the reclosable bag.

The closure arrangement 10 is manufactured using conventional extrusion and heat sealing techniques. In particular, the base strips 16, 18, the peelable strips 20, 22, and the closure profiles 30, 32 are co-extruded through a die plate fed by a plurality of extruders. These extruders carry the different molten materials for forming the base strips 16, 18, the peelable seals 20, 22, and the closure profiles 30, 32. As is well-known in the art, the die plate includes input ports, output ports, and channels connecting these input ports to output ports. The extruders feed the different molten materials to different input ports, and the channels are designed to configure the molten materials into the shapes of the base strips 16, 18, the peelable strips 20, 22, and the closure profiles 30, 32. The output ports are arranged such that the base strips 16, 18, the peelable strips 20, 22, and the closure profiles 30, 32 exit the die plate with the connections shown in FIG. 1. Since the base strip 16, male closure profile 30, and the peelable strip 20 are separated from the base strip 18, the female closure profile 32, and the peelable strip 22, it should be apparent that these two separate sets of elements may be formed in separate extrusions using two different die plates.

After extruding the base strips 16, 18, the peelable strips 20, 22, and the closure profiles 30, 32, the top and bottom films 12, 14 are heat-fused to the respective base strips 16, 18 using heat seal bars. These heat seal bars are also employed to generate a peelable seal between the peelable strips 20, 22 (FIG. 2).

During manufacture of the closure arrangement 10, the various bonds or attachments between different materials are formed such that the weakest bond is formed at the location of the peelable seal. By forming the weakest bond at the location of the peelable seal, the application of opening forces to the closure arrangement 10 will cause the peelable seal to rupture first. Since the other bonds are stronger than the peelable seal, these other bonds will not rupture in response to the application of opening forces.

The peelable strips 20, 22 are disposed opposite each other along the length of the bag mouth so that they may be heat sealed to form a peelable seal between the peelable strip 20, 22. Prior to forming the peelable seal, the peelable strips 20, 22 are unattached as shown in FIG. 1. After forming the peelable seal, the peelable strips 20, 22 are attached to each other (FIG. 2). As shown in FIG. 2, after forming the peelable seal but prior to initially opening a polymeric bag incorporating the closure arrangement 10, the peelable seal formed by the peelable strips 20, 22 is intact, the closure profiles 30, 32 are interlocked with each other, and the top and bottom films 12, 14 are connected at the mouth end of the bag. The top and bottom films 12, 14 either are heat-fused together at the mouth end of the bag or are formed from a single piece of film. Since the peelable seal between the peelable strips 20, 22 already provides a hermetic seal for the bag, the top and bottom films 12, 14 may alternatively be disconnected from each other at the mouth end.

Referring to FIG. 3, to open the bag, the top and bottom films 12, 14 are separated from each other by cutting them apart. Next, the interlocked closure profiles 30, 32 are detached from each other by grabbing onto the top and bottom films 12, 14 and pulling them apart. Finally, the peelable seal between the peelable strips 20, 22 is broken by continuing to pull the top and bottom films 12, 14 in opposite directions. During breakage of the peelable seal, the peelable strip 20 remains attached to the base strip 16, and the peelable strip 22 remains attached to the base strip 18.

To provide evidence of tampering, breaking the peelable seal of the closure arrangement 10 causes the peelable seal region to undergo a change in appearance and texture. This change in appearance provides the consumer with a visual indication that the peelable seal has been broken. In one embodiment, the peelable strip 20 is dyed a first opaque color such as blue, black, purple, green, etc., and the peelable strip 22 is dyed a second color, such as yellow, white, orange, etc., which is lighter than the first color. This second color may either be somewhat translucent or virtually opaque.

When the peelable strips 20, 22 are aligned next to one another prior to forming the peelable seal (FIG. 1), the darker first color of the peelable strip 20 cannot be seen through the lighter second color of the peelable strip 22 when viewing the polymeric bag from the right side in FIG. 1. The second color of the peelable strip 22 substantially masks the first color of the peelable strip 20. Similarly, lighter second color of the peelable strip 22 cannot be observed through the darker first color of the peelable strip 20 when viewing the polymeric bag from the left side in FIG. 1. When, however, the two peelable strips 20, 22 are heat sealed to each other to form a peelable seal, the darker first color of the peelable strip 20 is clearly visible through the lighter second color of the peelable strip 22 only in the area that has been heat sealed by a heat seal bar, though minute speckles of the lighter color may remain visible in the heat seal area. In one embodiment, the color of the heat sealed area is a blend of the first and second colors. The portion of the peelable strip 20 outside the heat-sealed area remains hidden or obscured by the peelable strip 22. After the peelable seal is broken, by accident in transit or by deliberate tampering, the darker color will no longer show through the lighter color. This masking condition is irreversible so that once the peelable seal is broken, the peelable seal can never again resemble an intact seal. In addition to generating the masking condition, breaking the peelable seal also roughens the texture of the peelable strips 20, 22.

If, for example, the first opaque color is blue and the second opaque color is yellow, forming a peelable seal allows one to see the blue color of the peelable strip 20 through the yellow peelable strip 22 only in the area where the heat seal bar has been applied. In one embodiment, the heat sealed area is a slightly different shade of blue compared to the original blue color of the peelable strip 20. Once the peelable seal is broken, the blue color of the peelable strip 20 will no longer be visible through the yellow peelable strip 22. The yellow peelable strip 22 substantially conceals the blue peelable strip 22 even if the two peelable strips 20, 22 are manually pressed together. As stated above, this masking condition is irreversible.

In an alternative embodiment, the peelable strips 20, 22 are each colorless and are each translucent or hazy due to the roughened inner surfaces of the peelable strips 20, 22. When the peelable strips 20, 22 are lying atop one another but are not yet heat sealed to one another, the area of the peelable strips 20, 22 is opaque or hazy. When, however, the two peelable strips 20, 22 are heat sealed to each other to form a peelable seal, the area where a heat seal bar has been applied is substantially clear because the heat seal bar smooths the roughened surfaces of the peelable strips 20, 22 in the area of the peelable seal. When the peelable seal is broken, the area of the peelable seal reverts back to being hazy.

Figure 6:
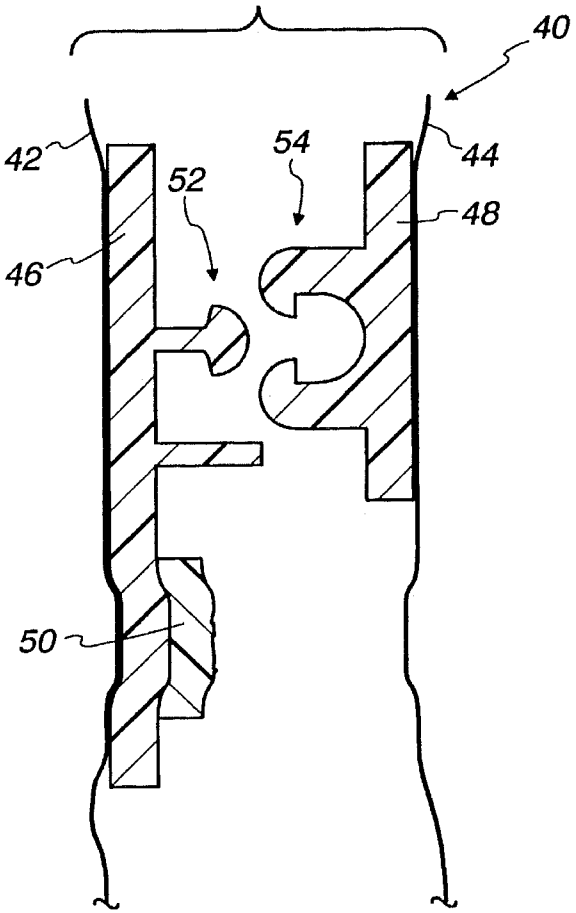
FIG. 6 is the same sectional view as in FIG. 4, after breaking the peelable seal.
Figure 5:
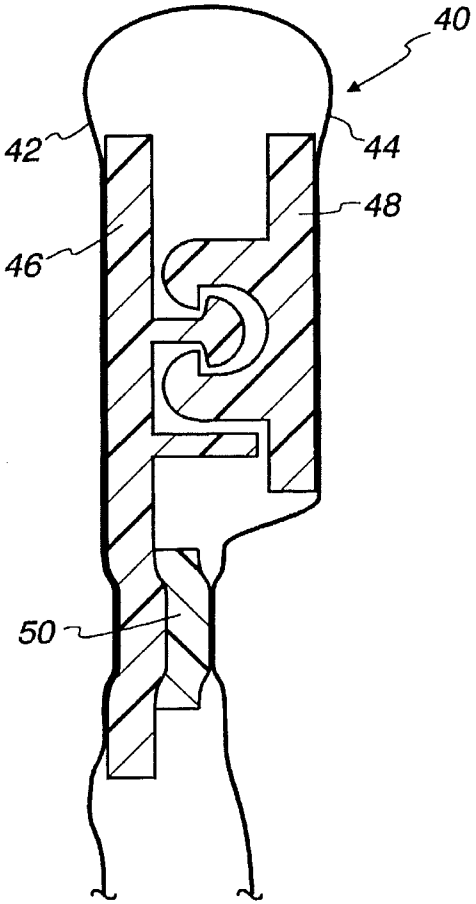
FIG. 5 is the same sectional view as in FIG. 4, after forming the peelable seal.
Figure 4:
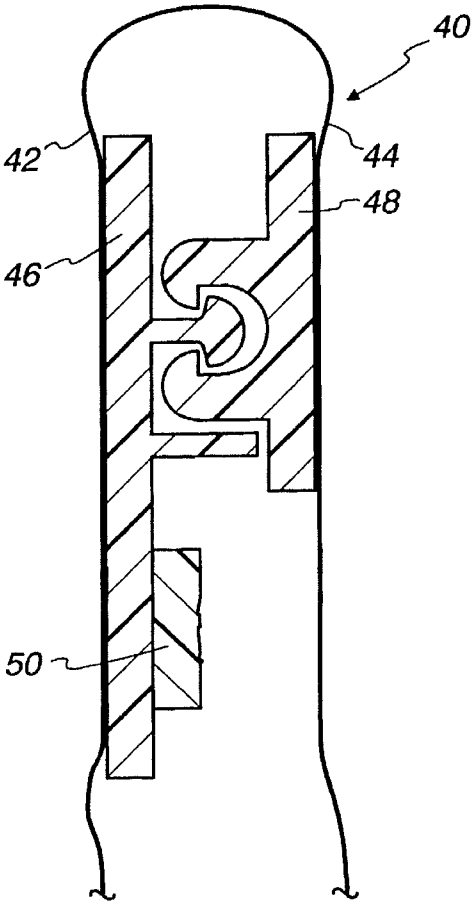
FIG. 4 is a sectional view of another closure arrangement embodying the present invention, prior to forming a peelable seal.

FIGS. 4–6 illustrate an alternative closure arrangement 40 for a reclosable bag having a top film 42 and a bottom film 44. The closure arrangement 40 includes a pair of flat transparent base strips 46, 48 and a single flat peelable strip 50. The base strips 46, 48 and the peelable strip 50 are disposed at the mouth of the reclosable bag and extend along the length of the bag mouth. An outer surface of the base strip 46 is firmly attached to an inner surface of the top film 42. The base strip 48 is generally parallel to and opposes the base strip 46, and an outer surface of the base strip 48 is firmly attached to an inner surface of the bottom film 44. To accommodate the peelable strip 50, the base strip 46 is wider, i.e., has a longer vertical dimension in FIGS. 4–6, than the base strip 48. The peelable strip 50 is attached to the inner surface of the base strip 46 and is disposed between the base strip 46 and the bottom film 44. If desired, the base strips 46, 48 may be provided with a reclosable zipper with associated male and female closure profiles 52, 54. The interaction of these closure profiles 52, 54 is identical to the interaction of the closure profiles 30, 32 described in connection with FIGS. 1–3.

Like the closure arrangement 10 in FIGS. 1–3, the closure arrangement 40 in FIGS. 4–6 is manufactured using conventional extrusion and heat sealing techniques. The base strips 46, 48, the peelable strip 50, and the closure profiles 52, 54 are preferably co-extruded with each other through a single die plate. If desired, however, separate die plates may be used to separately extrude the opposite sides of the closure arrangement 40. After extruding the aforementioned elements of the closure arrangement 40, the top and bottom films 42, 44 are heat-fused using heat seal bars to the respective base strips 46, 48. These heat seal bars are also employed to generate a peelable seal between the peelable strip 50 and the bottom film 44 (FIG. 5).

Prior to forming the peelable seal, the peelable strip 50 and the bottom film 44 are unattached as shown in FIG. 4. After forming the peelable seal, the peelable strip 50 is attached to the bottom film 44 (FIG. 5). As shown in FIG. 5, after forming the peelable seal but prior to initially opening a polymeric bag incorporating the closure arrangement 40, the peelable seal formed by the peelable strip 50 and the bottom film 44 is intact, the closure profiles 52, 54 are interlocked with each other, and the top and bottom films 42, 44 are connected at the mouth end of the bag. The top and bottom films 42, 44 either are heat-fused together at the mouth end of the bag or are formed from a single piece of film. Since the peelable seal between the peelable strip 50 and the bottom film 44 already provides a hermetic seal for the bag, the top and bottom films 42, 44 may alternatively be disconnected from each other at the mouth end.

Referring to FIG. 6, to open the bag, the top and bottom films 42, 44 are separated from each other by cutting them apart. Next, the interlocked closure profiles 52, 54 are detached from each other by grabbing onto the top and bottom films 42, 44 and pulling them apart. Finally, the peelable seal between the peelable strip 50 and the bottom film 44 is broken by continuing to pull the top and bottom films 42, 44 in opposite directions. During breakage of the peelable seal, the peelable strip 50 remains attached to the base strip 46.

To provide evidence of tampering, breaking the peelable seal of the closure arrangement 40 causes the peelable seal region to undergo a change in appearance and texture. This change in appearance is a visual signal that the peelable seal has been broken. The bottom film 44 of the polymeric bag is pigmented a somewhat translucent first color, such as white, yellow, orange, etc., either by being printed with a layer of ink or being dyed with ink. If desired, this first color may be virtually opaque. The peelable strip 50 is dyed a second opaque color, such as blue, black, purple, green, etc., which is darker than the first color of the bottom film 44.

When the peelable strip 50 and the bottom film 44 are aligned next to one another prior to forming the peelable seal (FIG. 4), the darker second color of the peelable strip 50 can hardly be seen through the lighter first color of the bottom film 44 when viewing the polymeric bag from the right side in FIG. 4. The first color of the bottom film 44 substantially masks the second color of the peelable strip 50. When the darker peelable seal 50 is heat sealed to the lighter colored bottom film 44 to form a peelable seal, the darker second color of the peelable strip 50 is clearly visible through the lighter first color of the bottom film 44 in the area that has been heat sealed by a heat seal bar. The bottom film 44 still substantially obscures the second color of the peelable strip 50 in the area outside the heat sealed area. When, however, the peelable seal between the peelable strip 50 and the bottom film 44 is broken, the darker peelable strip 50 can barely be seen through the lighter colored bottom film 44, even when the peelable strip 50 and the bottom film 44 are manually pressed together. This masking condition is irreversible.

If, for example, the bottom film 44 is colored white and the peelable strip 50 is colored opaque blue, the formation of a peelable seal allows one to see the blue color of the peelable strip 50 through the white bottom film 44 in the area where the heat seal bar was applied. Once the peelable seal is broken, the blue color of the peelable strip 50 will barely be visible through the white bottom film 44. The white bottom film 44 substantially conceals the blue peelable strip 50 even if the peelable strip 50 and the bottom film 44 are manually pressed together.

The preferred compositions of the various portions of the closure arrangements 10 and 40 are described below. More specifically, the peelable material used to form the peelable strips 20, 22 in FIGS. 1–3 and the peelable strip 50 in FIGS. 4–6 is a mixture of three components. First, the peelable material includes an ethylene vinyl acetate (EVA) copolymer such as Product No. AT 3325M EVA manufactured by AT Plastics, Inc. of Edmonton, Alberta, Canada. Second, the peelable material includes a polyethylene-based wax such as C-15 Epolene Wax manufactured by Eastman Chemical Company of Longview, Tex. Third, the peelable material includes a polypropylene such as ESCORENE® manufactured by Exxon Chemical Company of Baytown, Tex. The weight percentages of the foregoing three components of the peelable material preferably are 20–80% EVA copolymer, 5–45% polyethylene-based wax, and 5–45% polypropylene. The peelable material is colored as described previously by the addition of an appropriate dye.

The base material used to form the base strips 16, 18 in FIGS. 1–3, the closure profiles 30, 32 in FIGS. 1–3, the base strips 46, 48 in FIGS. 4–6, and the closure profiles 52, 54 in FIGS. 4–6 is preferably composed of a heat resistant mixture of two components. First, the base material includes a low density polyethylene such as Product No. 412FA manufactured by Westlake Polymers Corporation of Lake Charles, La. Second, the base material includes a polypropylene such as ESCORENE® manufactured by Exxon Chemical Company of Baytown, Tex. The preferred weight percentages are 90% low density polyethylene and 10% EVA copolymer manufactured by Exxon Chemical Company as Product Number 722.62. Alternatively, the base material may be composed of Rexene 1205C manufactured by Rexene Corporation of Odessa, Tex. The primary characteristics of the base material are that it bonds readily to the peelable material of the peelable strips and it provides a modicum of thermal resistance so that it does not melt while bonding other materials thereto.

The top and bottom films 12, 14 in FIGS. 1–3 and the top and bottom films 42, 44 in FIGS. 4–6 are preferably composed of two or more layers of material. The outer layer of material is a heat-resistant material such as polyethylene terephathalate, oriented polypropylene, or biaxially-oriented nylon. The inner layer of material is a sealant material such as a combination of low density polyethylene and ethylene vinyl acetate.

While the present invention has been described with reference to several particular embodiments, those skilled in the art will recognize that many changes may be made thereto without departing from the spirit and scope of the present invention.

For example, the closure arrangements 10 and 40 may be modified either to remove the reclosable zipper or to position the reclosable zipper below, instead of above, the peelable seal. In the latter situation, the base strips of each closure arrangement are provided with a lower flange portion with closure profiles attached respectively thereto. Furthermore, the closure arrangements 10 and 40 may be designed without their base strips so that the peelable strips and the reclosable zippers are attached directly to the top and bottom films of the reclosable bag.

In addition, the closure arrangement 40 in FIGS. 4–6 may be designed to provide a peelable seal between the peelable strip 50 and the base strip 48, where the base strip 48 is widened to appear similar to the base strip 18 in FIGS. 1–3. In this case, the widened base strip 48 is pigmented the lighter first color, and the peelable strip 50 is still pigmented the darker second color.

Each of these embodiments and obvious variations thereof is contemplated as falling within the spirit and scope of the claimed invention, which is set forth in the following claims.

What is claimed is:

1. A closure arrangement for a polymeric bag, comprising:

a first panel having inner and outer surfaces;

a second panel having inner and outer surfaces, said second panel being generally parallel to and opposing said first panel;

a first peelable strip of a first color attached to said inner surface of said first panel and disposed between said first and second panels; and a second peelable strip of a second color attached to said inner surface of said second panel and disposed between said first and second panels, said second color being lighter than said first color, said second peelable strip being generally parallel to and opposing said first peelable strip, said first color of said first peelable strip being visible through said second peelable strip when said first and second peelable strips are heat sealed to each other to form a peelable seal, said second color of said second peelable strip substantially masking said first color of said first peelable strip when said peelable seal is broken.

2. The closure arrangement of claim 1, wherein said first color is opaque and said second color is translucent.

3. The closure arrangement of claim 2, wherein said first color is blue and said second color is yellow.

4. The closure arrangement of claim 1, wherein said first and second panels form respective first and second base strips, said outer surfaces of said first and second panels being adapted for attachment to respective opposing films of the polymeric bag.

5. The closure arrangement of claim 1, further including first and second interlocking closure profiles attached to said inner surfaces of said respective first and second panels.

6. The closure arrangement of claim 5, wherein said first closure profile includes a pair of locking members and said second closure profile includes a single locking member releasably engageable between said pair of locking members.

7. A closure arrangement for a polymeric bag having first and second opposing films, comprising:

a first base strip having inner and outer surfaces, said outer surface of said first base strip being attached to an inner surface of the first film;

a second base strip having inner and outer surfaces, said second base strip being generally parallel to and opposing said first base strip, said outer surface of said second base strip being attached to an inner surface of the second film;

a first peelable strip of a first color attached to said inner surface of said first base strip and disposed between said first and second base strips; and a second peelable strip of a second color attached to said inner surface of said second base strip and disposed between said first and second base strips, said second color being lighter than said first color, said second peelable strip being generally parallel to and opposing said first peelable strip, said first color of said first peelable strip being visible through said second peelable strip when said first and second peelable strips are heat sealed to each other to form a peelable seal, said second color of said second peelable strip substantially masking said first color of said first peelable strip when said peelable seal is broken.

8. The closure arrangement of claim 7, further including first and second interlocking closure profiles attached to said inner surfaces of said respective first and second panels.

9. The closure arrangement of claim 8, wherein said first closure profile includes a pair of locking members and said second closure profile includes a single locking member releasably engageable between said pair of locking members.

10. A method of manufacturing a closure arrangement for a polymeric bag, comprising the steps of:

forming a first panel having inner and outer surfaces;

forming a second panel having inner and outer surfaces, said second panel being generally parallel to and opposing said first panel;

forming a first peelable strip of a first color between said first and second panels, and attaching said first peelable strip to said inner surface of said first panel;

forming a second peelable strip of a second color between said first and second panels, and attaching said second peelable strip to said inner surface of said second panel, said second color being lighter than said first color, said second peelable strip being generally parallel to and opposing said first peelable strip; and heat sealing said first and second peelable strips to each other to form a peelable seal such that said first color of said first peelable strip is visible through said second peelable strip, said second color of said second peelable strip substantially masking said first color of said first peelable strip when said peelable seal is broken.

11. A closure arrangement for a polymeric bag, comprising:

a first panel having inner and outer surfaces;

a second panel of a first color having inner and outer surfaces, said second panel being generally parallel to and opposing said first panel; and a peelable strip of a second color attached to said inner surface of said first panel and disposed between said first and second panels, said first color being lighter than said second color, said second color of said peelable strip being visible through said second panel when said peelable strip and said second panel are heat sealed to each other to form a peelable seal, said first color of said second panel substantially masking said second color of said peelable strip when said peelable seal is broken.

12. The closure arrangement of claim 11, wherein said second color is opaque and said first color is translucent.

13. The closure arrangement of claim 12, wherein said second color is blue and said first color is white.

14. The closure arrangement of claim 11, wherein said first panel forms a first base strip, said outer surface of said first panel being adapted for attachment to one of a pair of opposing films of the polymeric bag.

15. The closure arrangement of claim 14, wherein said second panel forms the other of the pair of opposing films of the polymeric bag.

16. The closure arrangement of claim 15, further including a second base strip having inner and outer surfaces, said outer surface of said second base strip being attached to said inner surface of said second panel, said second base strip being generally parallel to and opposing said first panel.

17. The closure arrangement of claim 16, further including first and second interlocking closure profiles attached to said inner surfaces of said respective first panel and said second base strip.

18. The closure arrangement of claim 17, wherein said first closure profile includes a pair of locking members and said second closure profile includes a single locking member releasably engageable between said pair of locking members.

19. A closure arrangement for a polymeric bag having first and second opposing films, comprising:

a first base strip having inner and outer surfaces, said outer surface of said first base strip being attached to an inner surface of the first film;

a second base strip having inner and outer surfaces, said second base strip being generally parallel to and opposing said first base strip, said outer surface of said second base strip being attached to an inner surface of the second film, the second film being of a first color; and a peelable strip of a second color attached to said inner surface of said first base strip and disposed between said first base strip and the second film, said first color being lighter than said second color, said second color of said peelable strip being visible through the second film when said peelable strip and the second film are heat sealed to each other to form a peelable seal, said first color of the second film substantially masking said second color of said peelable strip when said peelable seal is broken.

20. The closure arrangement of claim 19, further including first and second interlocking closure profiles attached to said inner surfaces of said respective first and second base strips.

21. The closure arrangement of claim 20, wherein said first closure profile includes a pair of locking members and said second closure profile includes a single locking member releasably engageable between said pair of locking members.

22. A method of manufacturing a closure arrangement for a polymeric bag, comprising:

forming a first panel having inner and outer surfaces;

forming a second panel of a first color having inner and outer surfaces, said second panel being generally parallel to and opposing said first panel;

forming a peelable strip of a second color between said first and second panels, and attaching said peelable strip to said inner surface of said first panel, said first color being lighter than said second color; and heat sealing said peelable strip and said second panel to each other to form a peelable seal such that said second color of said peelable strip is visible through said second panel, said first color of said second panel substantially masking said second color of said peelable strip when said peelable seal is broken.

* * * * *